US006266485B1

(12) United States Patent
DeSantis et al.

(10) Patent No.: US 6,266,485 B1
(45) Date of Patent: Jul. 24, 2001

(54) ONE-PIECE PLASTIC TANK AND TEMPERATURE CONTROL SYSTEM FOR A HOT WATER DISPENSER

(75) Inventors: Paul M. DeSantis, Racine; Terrence W. Snyder, Mt. Pleasant; Wayne C. Riley, Sturtevant; Will J. Preischel, Racine, all of WI (US); Dale L. Garrison, Gilbert, AZ (US); Henry A. Jones, Jr., Oak Creek, WI (US); Richard W. Fitzgerald, Franklin, WI (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/396,387

(22) Filed: Sep. 15, 1999

Related U.S. Application Data

(63) Continuation-in-part of application No. 09/026,070, filed on Feb. 19, 1998, now Pat. No. 6,094,524.

(51) Int. Cl.[7] ..... F24H 1/20; H05B 3/78

(52) U.S. Cl. ..... 392/452; 392/447; 222/146 HE

(58) Field of Search ..... 392/441, 445, 392/447, 449, 451, 452, 498

(56) References Cited

U.S. PATENT DOCUMENTS

| | | | | |
|---|---|---|---|---|
| 3,642,176 | * | 2/1972 | Dreibelbis et al. . | |
| 3,793,934 | | 2/1974 | Martin . | |
| 3,836,050 | | 9/1974 | Dreibelbis . | |
| 3,891,124 | * | 6/1975 | Dreibelbis . | |
| 3,905,518 | | 9/1975 | Dreibelbis et al. . | |
| 3,927,802 | * | 12/1975 | Lavochkin et al. | 222/67 |
| 4,263,498 | * | 4/1981 | Meyers . | |
| 4,354,094 | | 10/1982 | Massey et al. | 219/306 |
| 4,455,477 | | 6/1984 | Massey et al. | 219/328 |
| 4,513,887 | * | 4/1985 | Wicke et al. . | |
| 5,099,825 | | 3/1992 | Massey et al. | 126/383 |
| 5,103,859 | | 4/1992 | Martin et al. | 137/448 |
| 5,692,096 | | 11/1997 | Massey et al. | 392/464 |
| 5,923,819 | | 7/1999 | Ross et al. | 392/441 |

FOREIGN PATENT DOCUMENTS

| | | | |
|---|---|---|---|
| 64500/90 | 4/1991 | (AT) . | |
| 6582/90 | 5/1991 | (AT) . | |
| 80474/94 | 6/1995 | (AT) . | |
| 9003794 | 6/1990 | (DE) | F24H/9/20 |
| 19636143 | 10/1997 | (DE) | F24H/9/02 |
| 0209867 | 1/1987 | (EP) | F24H/1/10 |
| 0790411 | 8/1997 | (EP) | F15B/1/12 |
| 2 065 848A | 7/1981 | (GB) . | |
| 61202048 | 9/1986 | (JP) | F24H/9/20 |
| WO 9934153 | 7/1999 | (WO) . | |

* cited by examiner

*Primary Examiner*—Teresa Walberg
*Assistant Examiner*—Thor Campbell
(74) *Attorney, Agent, or Firm*—Howrey Simon Arnold & White LLP

(57) ABSTRACT

A hot water dispensing system comprises a one-piece plastic tank having a main heating chamber, an expansion chamber, and an air collection chamber. The air collection chamber is disposed generally below the expansion chamber and alongside the main heating chamber. The main heating chamber is in fluid communication with the expansion chamber and the air collection chamber. The hot water dispensing system also includes a temperature control system having a heating element, a metal temperature sensing bracket, and a thermostat. The heating element is disposed within the plastic tank and connected to a metal temperature sensing bracket disposed outside the tank. The excellent conductive properties of a metal sheath that connects the metal temperature sensing bracket to the heating element allow the metal temperature sensing bracket to simulate changes in the temperature of water in the tank. The thermostat is mounted to the metal temperature sensing bracket and measures a temperature of the metal temperature sensing bracket and activates or deactivates a heating element in response to the measured temperature of the metal temperature sensing bracket.

28 Claims, 3 Drawing Sheets

ONE-PIECE PLASTIC TANK AND TEMPERATURE CONTROL SYSTEM FOR A HOT WATER DISPENSER

CROSS REFERENCE TO RELATED APPLICATION

This application is a continuation-in-part of U.S. Pat. application Ser. No. 09,026,070, now U.S. Pat. No. 09/026,070, filed Feb. 19, 1998.

FIELD OF INVENTION

The present invention relates generally to dedicated hot water dispensing stems. More particularly, the present invention relates to the use of a plastic tank and an external temperature control system in a dedicated hot water faucet system.

BACKGROUND OF THE INVENTION

The use of systems for heating and dispensing hot water is known in the market place. As used herein, "hot" refers to temperatures at or about 190° Fahrenheit (88° Celsius), but below the boiling point of water (212° Fahrenheit/100° Celsius). Water at this high temperature can be made available at a dedicated faucet for users needing hot water to make, for example, coffee, tea or cocoa. A typical preexisting system heats water in a relatively small tank that is situated below the sink on which the dedicated faucet is mounted. The tank may have a capacity of ⅓ or ½ gallons (1.3 or 1.9 liters). Such tanks are usually divided into two chambers, a main chamber and an expansion chamber. Water is heated electrically in the main chamber. The expansion chamber is contiguous with the main chamber and contains water that is initially heated in the main chamber and allowed to expand into the expansion chamber to preclude pressure buildup generated by heating the water.

Most known water heating chambers and tanks utilize metal fabricating wherein several pieces of metal must be integrated together to create separate air and watertight chambers. This metal construction is labor intensive, requires expensive cleaning operations during fabrication and is susceptible to leaks.

Most established metal tank systems utilize a temperature sensing system attached to the outside of a metal tank to directly sense the water temperature. The temperature of the metal on the outside of a hot water heating tank will register nearly the same temperature as the water inside the tank because metal conducts heat extremely well. Such temperature sensing systems would not effectively perform in the same manner with a plastic tank construction because a plastic tank does not efficiently conduct heat.

Accordingly, a need exists for a plastic water-heating tank with an exterior temperature sensing system that accurately and efficiently determines the water temperature inside the tank and adjusts that temperature accordingly.

SUMMARY OF THE INVENTION

The present invention provides a plastic hot water tank with a temperature control system that is durable and requires little maintenance yet also accurately and efficiently is able to determine and alter water temperatures within the plastic tank. The plastic hot water tank comprises a main heating chamber and an expansion chamber. Supply line water enters the tank at a venturi valve and proceeds into an air collection chamber before emptying into the main heating chamber. The venturi valve limits the water pressure within the tank and eliminates undesirable air from being emitted at a faucet.

The temperature control system comprises a heating element located within the hot water tank, a metal temperature sensing bracket, means for connecting the temperature bracket to the heating element and a thermostat. The thermostat is attached to the temperature bracket on the outside of the tank. This thermostat is able to sense the water temperature because the excellent conductive properties of the metal means for connecting the temperature bracket to the heating element allow the temperature bracket to simulate changes in water temperature.

BRIEF DESCRIPTION OF THE DRAWINGS

Other objects and advantages of the invention will become apparent upon reading the following description of illustrative embodiments and upon reference to these drawings.

Figure 3:
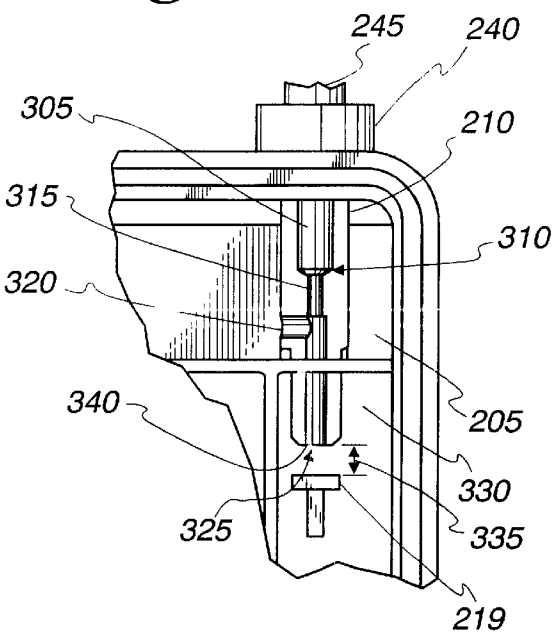
FIG. 3 is an enlarged view of a venturi valve aspirator of the hot water dispensing system.

While the invention is susceptible to various modifications and alternative forms, specific embodiments thereof have been shown by way of example in the drawings and will herein be described in detail. It should be understood, however, that it is not intended to limit the invention that the particular forms disclosed, but on the contrary the invention is to cover all modifications, equivalents, and alternatives that fall within the spirit and scope of the invention as defined by the appended claims.

DESCRIPTION OF ILLUSTRATIVE EMBODIMENTS

Figure 1:
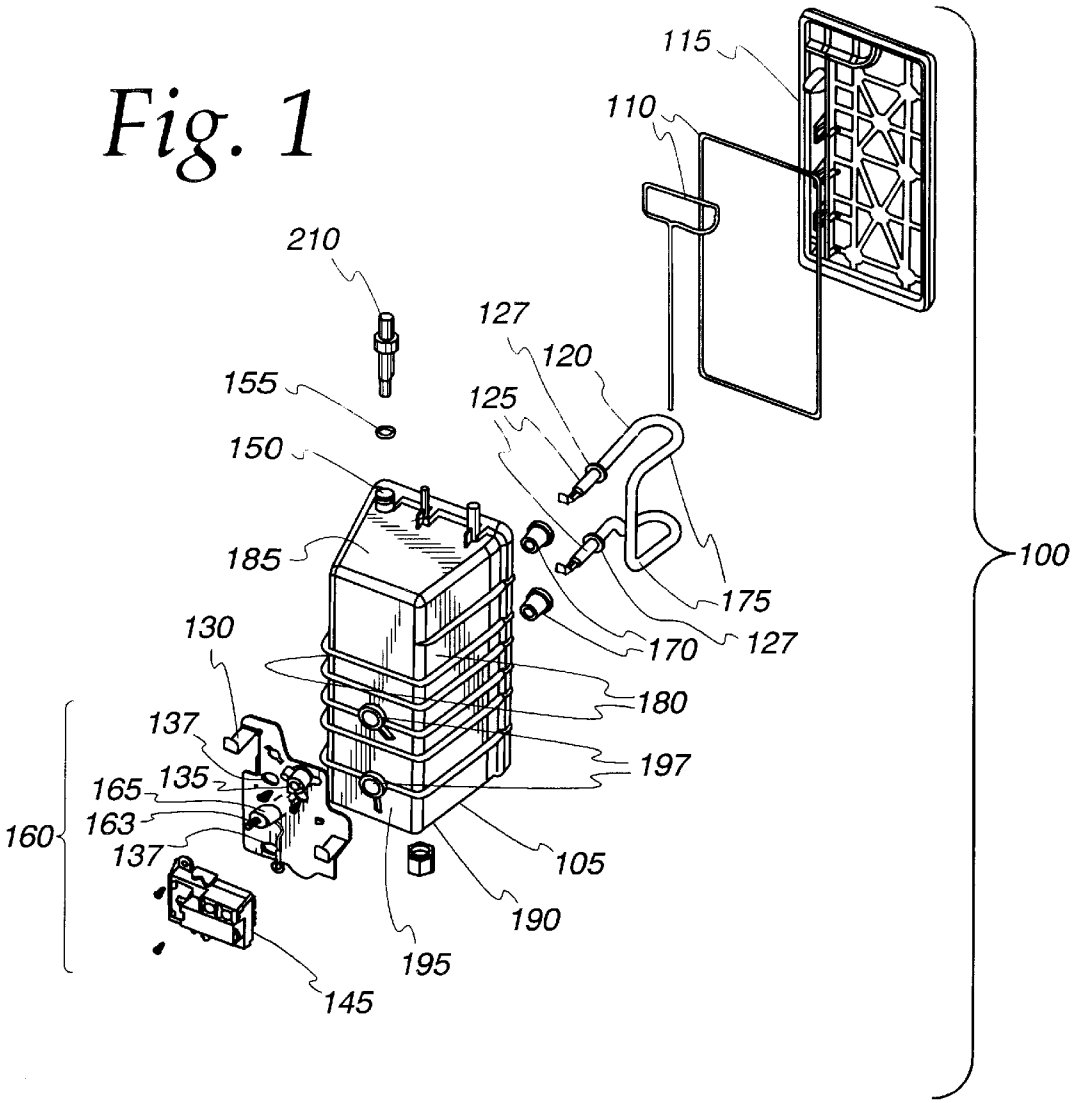
FIG. 1 is an exploded view of a heating tank assembly of the hot water dispensing system.

FIG. 1 depicts an exploded view of heating tank assembly 100. The heating tank assembly includes, among other things, a tank body 105, Emaweld ® strands 110 and 155, a tank cover 115, a heating element 120, a temperature control system 160 and a venturi valve 210.

The tank body 105 is formed from a plastic material and is comprised of two side walls 180, a top wall 185, a bottom wall 190 and a rear wall 195 containing two orifices 197. The design of one embodiment of the present invention is described as a one-piece plastic tank construction. Each tank chamber, the venturi valve and all inlet/outlet ports are all injection molded using conventional techniques and preferably composed of plastic. The one-piece plastic molded configuration of one embodiment of the present invention greatly reduces the cost and labor required to make the tank as well as significantly reducing the potential for leaks. The plastic tank is considered to be onepiece after a tank cover 115 and a venturi valve 210 are integrally heat bonded to the five-sided tank body 105 using an Emabond ® electromagnetic welding system. The Emabond ® welding system is commercially available from the Ashland Chemical Company of Columbus, Ohio.

The Emabond ® welding system utilizes ferromagnetic material called Emaweld ® that is placed between the tank body 105 and the tank cover 115. The Emaweld ® sections are spaghetti-type bonding strands that are subjected to alternating magnetic fields that cause the strands to melt and fuse the tank body 105 to the tank cover 115, creating structural, hermetic, pressure-tight and leak-proof seals. The heat-bonded tank cover 115 eliminates the need for a sealing system with additional materials and components, i.e., fasteners, sealing materials, etc. The elimination of metal components from the construction of the plastic tank further reduces heat loss from the water through the high heat conductivity of metal. Before the tank cover 115 is heat bonded to the tank body 105, the silicone cylindrical bushings 170 and the heating element 120 are inserted. As shown in FIG. 1, the silicone cylindrical bushings 170 are inserted into two orifices 197 in the rear wall 195 of the tank body 105 and heating element 120 is placed inside the main heating chamber 200 of the tank body 105. A metal washer 127 is welded to each arm 125 of the heating element 120. The two arms 125 of the heating element 120 are inserted into and extended through the silicone cylindrical bushings 170 until the metal washers 127 prevent further passage of each arm 125 of the heating element 120 through the silicone cylindrical bushings 170.

Because the tank body 105 is of plastic construction, a unique system for sensing the water temperature inside the water-heating chambers is also provided. A metal temperature sensing bracket 1 30 is located on the outside of the tank body 105 and is crimped to the two arms 125 of the heating element 120 as described below. It has been contemplated in accordance with the present invention that the temperature bracket 130 may be composed of copper or a composite of various metals. Two orifices 137 in the temperature bracket 130 correspond to and are aligned with the respective two orifices 197 in the rear wall 195 of the tank body 105. The two arms 125 of the heating element 120 extend through the silicone cylindrical bushings 170, through the two orifices 197 in the rear wall 195 of the tank body 105 and emerge on the outside of the tank body 105. The two arms 125 subsequently reach through the two corresponding orifices 137 of the temperature bracket 130.

A sheath 175 is the outer covering of the entire heating element 120 and is composed of heat-conducting metal. The sheath is composed of metal to assist the temperature control system 160 in responding quickly to changes in the water temperature with the tank body 105. A crimping machine (not shown) crimps the outside of the two orifices 137 of the temperature bracket 130 onto the sheath portion 175 at the end of the two arms 125 of the heating element 120 to secure the temperature bracket 130 and the tank body 105 to the heating element 120. Crimping the orifices 137 of the temperature bracket 130 to the heating element 120 ensures a good metal connection between the temperature bracket 130 and the sheath 175. Because the temperature bracket 130 and the sheath 175 are excellent heat conductors, the temperature bracket 130 is able to detect changes in the water temperature through the heating element 120. A good connection between the temperature bracket 130 and the sheath 175 is needed to ensure that a thermostat 145 can accurately calculate and control the temperature of the water on the inside of the tank. The thermostat 145 is attached to the temperature bracket 130. A sensor at the bottom of the thermostat 145 senses the temperature of the temperature bracket 130 that correlates with the water temperature inside the tank body 105. This allows the use of a common, low cost thermostat. One example is a commercially available cycling thermostat from Therm-O-Disc, Inc., of Mansfield, Ohio. Typically, the thermostat 145 will maintain the water temperature inside the tank body 105 at around 190° Fahrenheit (88° Celsius), but always below the boiling temperature (212° Fahrenheit, 100° Celsius) of water.

Figure 4:
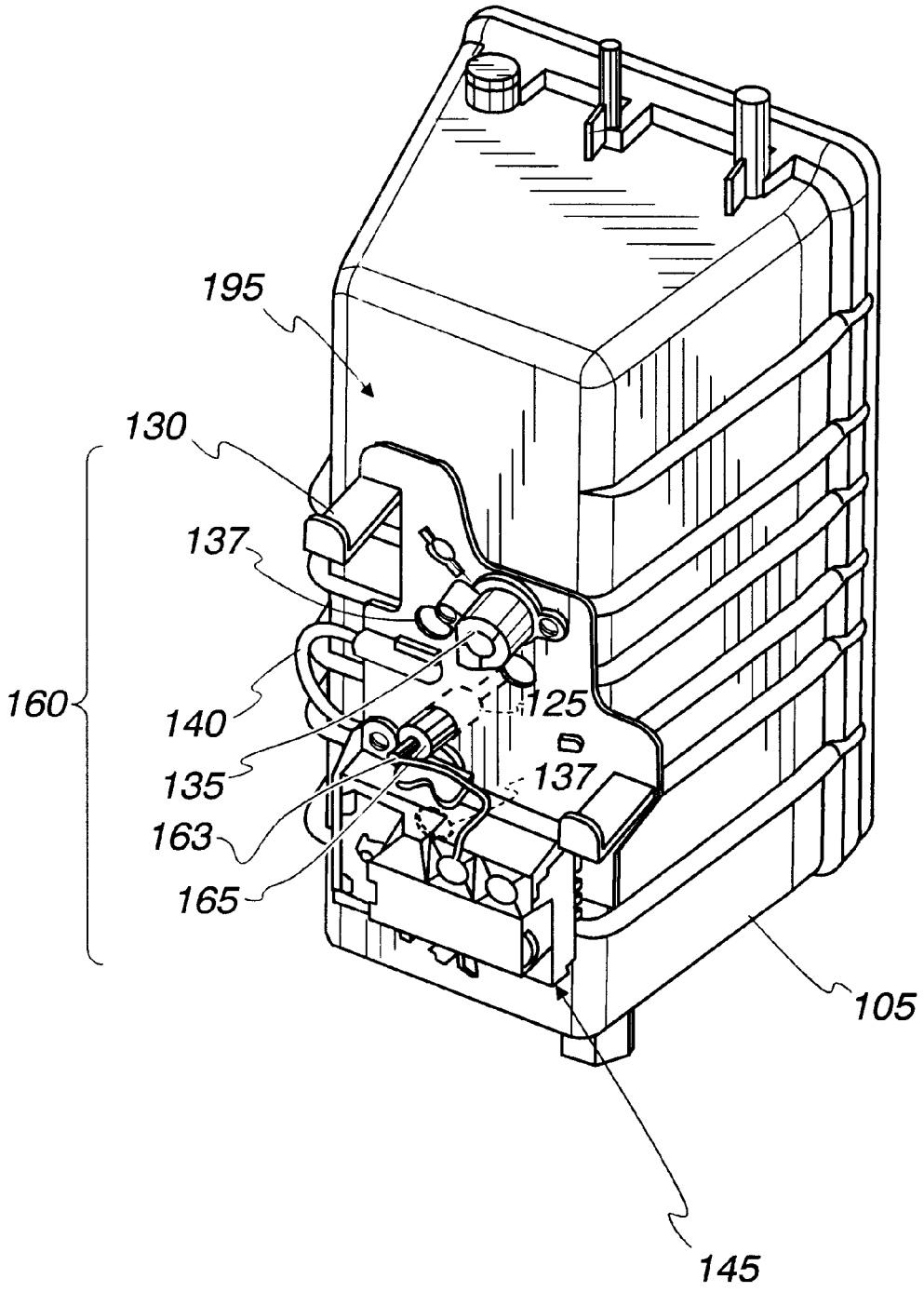
FIG. 4 is an assembly view of the temperature sensing system of the hot water dispensing system.

As shown in FIG. 4, a small tube 163 extends from each orifice 137 of the temperature bracket 130 (only one tube shown). A cold pin 165 extends from a position exterior to the tube 163, through the tube 163 and into the inside of the heating element 120. It is preferable that the cold pin 165 extends from about 0.5 inches to about 1.5 inches past the tube 163 and into the heating element 120 and more preferable that the cold pin extends about 1.0 inches past the tube 163 and into the heating element 120. A heater wire (not shown) within the heating element 120 on the interior of the tank body 105 is connected to the end of the cold pin 165 that extends into the heating element 120, as described above. It is contemplated in accordance with the present invention that the heater wire can be welded or crimped to the end of the cold pin 165.

When the temperature drops below a certain preset level, the thermostat 145 (via a wire connecting the thermostat 145 and the cold pin 165) directs a flow of current through the cold pin 165 and into the heater wire within the heating element 120. The current flows through the wire within the heating element 120 and exits at the cold pin at the other arm 125 of the heating element 120. Due to the resistive characteristics of the wire, the current passing through the wire produces heat, which, in turn, causes the temperature of the heating element 120 to increase. This subsequently causes the temperature of the water inside the tank body 105 to increase.

A packing material is placed within the tube 163 to secure the heater wire and the cold pin 165 within the tube 163 and to insulate the heater wire from touching the walls of the heating element 120. The packing material is packed using a vibration method to tightly compress the packing material. It is contemplated in accordance with the present invention that an example of the packing material used within the tube is magnesium oxide in powder form. A sealing compound is placed outside the packing material to seal the packing material and retard the absorption of moisture. One example of the sealing material used in accordance with the present invention is silicone liquid.

The temperature bracket 130 also provides excellent temperature sensing to a thermal cutout device (TCO) 135. The TCO is a limiting thermostat that protects the tank from abnormal conditions such as no or low water conditions in the tank by shutting off the heating element when the temperature reaches a preset maximum allowable temperature for the tank and/or system. The TCO 135 is mounted to the temperature bracket 130 and senses the temperature of the water in the same manner as the thermostat 145, as described above. The TCO 135, a conventional and low-cost temperature-sensing device, is noninvasive in that it eliminates the need to put yet another hole in the tank and provides a separate temperature sensor. Thus a simpler design is created, further reducing the cost of the heating system. One example of the TCO 135 is a limiting bimetal disc thermostat commercially available from Therm-O-Disc, Inc., of Mansfield, Ohio.

FIG. 4 is an assembled view of the temperature control system 160. The metal temperature sensing bracket 130 is located on the outside of the tank body 105. The thermostat 145 is directly connected to the temperature bracket 130. The thermal cutout device (TCO) 135 is also connected to the temperature bracket 130. A wire harness 140 allows the temperature control system 160 to obtain electrical power.

Figure 2:
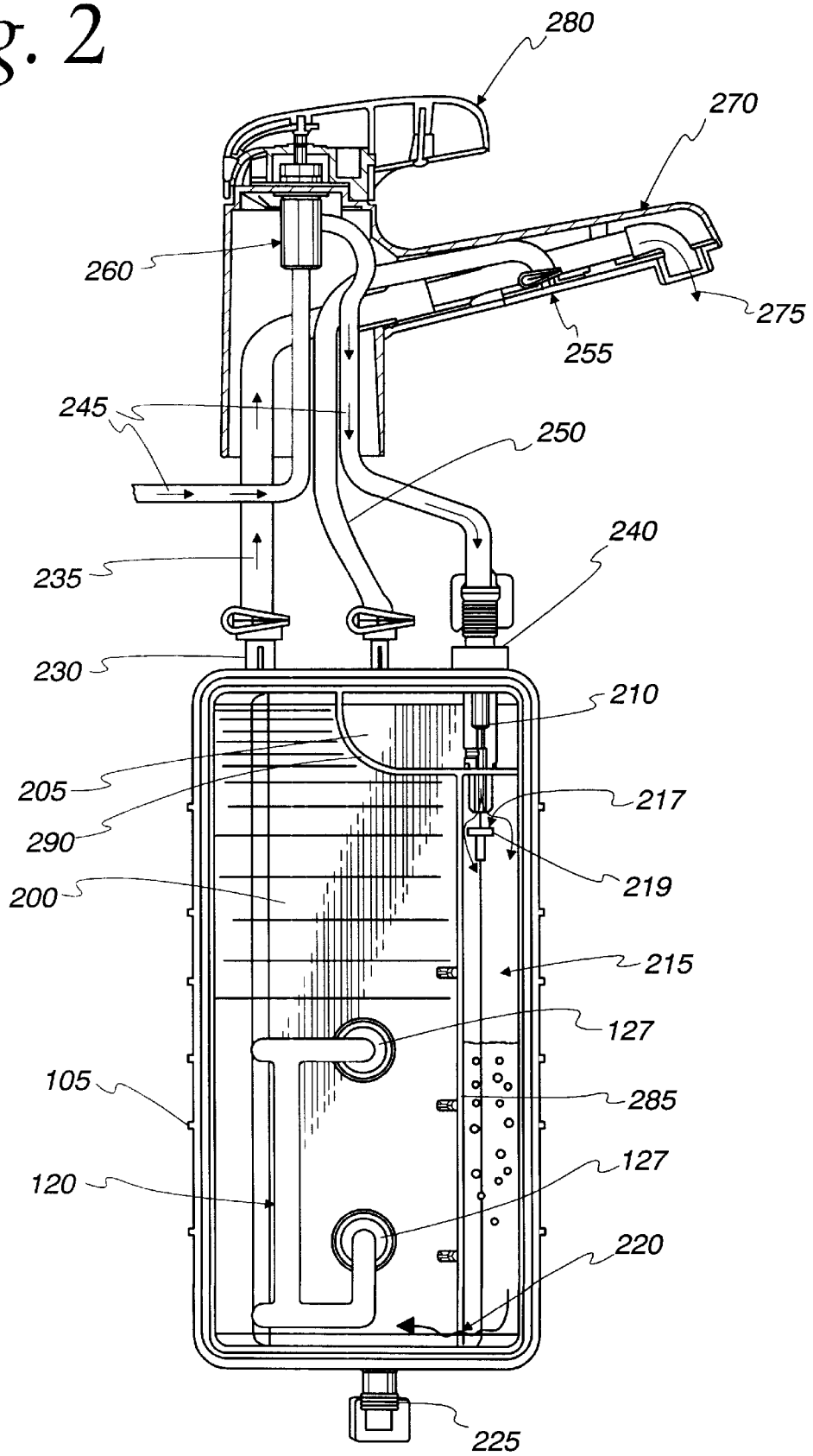
FIG. 2 is a cross-sectional view of an assembled hot water heating tank mounted to a dispensing faucet.

FIG. 2 depicts a cross-section of an assembled hot water dispensing system mounted to a dispensing faucet. The illustrated hot water dispensing system comprises a tank body 105 divided into a main heating chamber 200 and an expansion chamber 205 in fluid communication with and communicatively coupled to the main heating chamber 200. The tank body 105 includes an internal wall 285 separating the main heating chamber 200 from the air collection chamber 215 and another internal wall 290 separating the expansion chamber 205 from both the main heating chamber 200 and the air collection chamber 215. The bottom of the internal wall 285 includes an opening 220 to provide fluid communication between the main heating chamber 200 and the air collection chamber 215.

An undesirable feature of previously manufactured hot water dispensing systems arises when the water level in the expansion chamber drops to a level low enough for air to be drawn in through aspirator lateral hole(s) from the vented expansion chamber. In one embodiment of the present invention, the air collection chamber 215 is positioned within the tank body 105, residing generally below the expansion chamber 205 and adjacent to the main heating chamber 200. The incoming water supply line 245 provides water at line pressure to the plastic venturi valve 210 located within the expansion chamber 205 whenever a user actuates the operating handle 280 of the hot water faucet 270. Arrows in FIG. 2 indicate the flow direction of the water.

The venturi valve 210 directs entering water into the top 217 of the air collection chamber 215. The venturi valve is positioned within the expansion chamber 205 and is embedded to the tank through use of the previously described Emabond ® welding system. Specifically, in one embodiment of the present invention, the tank body 105, as shown in FIG. 1, comprises an orifice 150 with a vertical rim extending away from the orifice 150. The venturi valve 210 is placed through the orifice 150 and situated within the expansion chamber 205, as shown in FIG. 2. After the venturi valve 210 is inserted, a flange of the venturi valve 210 is disposed around the vertical rim of the orifice 150, creating a pocket between the flange of the venturi valve 210 and the vertical rim of the orifice 150. Referring back to FIG. 1, an Emaweld ® section 155 is installed within this pocket to embed the venturi valve 210 integral to the tank.

Referring to FIG. 2, in order to obtain hot water for consumption, a user actuates the operating handle 280 of the faucet 270. A supply line infeed valve 260 of the faucet is opened and closed by actuating an operating handle 280 of the faucet 270. It is contemplated in accordance with the present invention that user-initiated raising, pushing or turning can actuate the operating handle 280. Actuating the operating handle 280 causes water to be fed into the incoming water supply line 245, through the tank inlet 240 and into the venturi valve 210 located within the expansion chamber 205. Water in the main heating chamber 200 is heated by the heating element 120 and allowed to expand into the expansion chamber 205 through the venturi valve 210 and subsequently, the lateral hole 320 during times when water is being heated and expanded. It is contemplated in accordance with the present invention that more than one lateral hole may exist on the venturi valve 210. Water from the main heating chamber 200 does not expand into the expansion chamber 205 when water from the incoming water supply line 245 is traversing the venturi valve 210.

After water enters the venturi valve 210 from the incoming water supply line 245, negative pressure develops in the venturi valve 210 relative to the pressure in the expansion chamber 205. The negative pressure in the venturi valve 210 causes aspiration of hot water from the expansion chamber 205 into the air collection chamber 215. A jet stream mixture of hot water from the expansion chamber 205 and cold water from the incoming water supply line 245 is then projected from the venturi valve 210 into the top of the air collection chamber 215. When the expansion chamber 205 is emptied of water, air begins to be aspirated from the expansion chamber 205. Because air is lighter than the water, air is captured in the air collection chamber 215. Any air collected in the air collection chamber 215 is subject at its lower opened end to hydrostatic pressure from the water. The air collection chamber 215 can be filled sufficiently deep with air at a pressure that will balance against the water pressure in the tank.

As the collected air in the air collection chamber 215 pushes against the weight of the water in the tank, a positive pressure develops in the air collection chamber 215 and counters a vacuum pressure that develops in the venturi valve 210. The aspiration of air from the expansion chamber 205 slowly decreases with the increasing air pressure in the air collection chamber 215. The aspiration of air ceases when the air pressure in the air collection chamber 215 equals the vacuum pressure in the venturi valve 210. Water from the incoming water supply line 245 will still be fed into the venturi valve 210 as long as the faucet valve remains open.

After the water from the incoming water supply line 245 and the expansion chamber 205 is forced into the air collection chamber 215 through the venturi valve, the water arrives at the main heating chamber 200 via an opening 220 at the lower end of the air collection chamber 215. Hot water is then forced out of the main heating chamber 200, through the hot water line 235 and into the faucet 270 for consumer usage. The minimum square surface area of the water within the air collection chamber 215 is important. The square surface area of the water in the air collection chamber 215 is indirectly related to the amount of pressure required in the air collection chamber 215 and into the main heating chamber 200. The smaller the square surface area of the water, the greater the pressure that is required to force water out of the expansion chamber 205.

The air collection chamber 215 is located below the level of the expansion chamber 205 and is communicatively coupled to the main heating chamber 200. In one embodiment of the present invention, the air collection chamber 215 is rectangular and narrow relative to the main heating chamber 200. It is contemplated in accordance with the present invention that the air collection chamber 215 can be cylindrical or any other shape that would permit the passage of water as described in the present invention. It is also contemplated that the air collection chamber 215 could be about the same size or larger than the main heating chamber 200.

It is foreseeable but undesirable for the venturi jet velocity pressure to be extreme enough to drive collected air out of the bottom of the air collection chamber 215 and into the main heating chamber 200. This action is precluded in cases where such action could occur by installing a plastic deflector baffle 219 proximate to the exit end 340 of the venturi valve 210. The plastic deflector baffle 219 is arranged such that the venturi jet of water from the exit end 340 of the venturi valve 210 impinges upon the plastic deflector baffle 219 to dissipate the kinetic energy of the water and prevent air from exiting the air collection chamber 215 through the opening 220 at the bottom of internal wall 285. After impinging upon the plastic deflector baffle 219, the air and water separate. Without the baffle, air exiting the air collection chamber 215 and entering the main heating chamber 200 would rise to the top of the main heating chamber and bubbles of air would dispense with the outflowing hot water and produce undesired spitting and surging of air bubbles intermixed with the hot water exiting the main heating chamber 200 for consumer use. Instead of exiting the tank from the main heating chamber 200, air in the air collection chamber 215 must remain in the air collection chamber 215 to provide the necessary counterpressure to prohibit further aspiration of air from the expansion chamber 205. The plastic deflector baffle 219 of the present invention ensures that air will not depart from the air collection chamber 215 and enter the main heating chamber 200.

Maintaining the proper distance 335 between the exit end 340 of the venturi valve 210 and the plastic deflector baffle 219 will ensure an elimination of air bubbles in water leaving the tank for consumer usage. If the distance 335 from the exit end 340 of the venturi valve 210 to the plastic deflector baffle 219 is too small, water exiting the venturi valve 210 will bounce back at itself and change the aspiration pressure in the venturi valve 210. If the distance 335 is too large, the water exiting the venturi valve 210 will travel around the plastic deflector baffle 219 and render the baffle ineffective. The distance 335 from the exit end 340 of the venturi valve 210 to the plastic deflector baffle 219 is preferably from about 0.1 inches to about 0.8 inches, more preferably from about 0.2 inches to about 0.4 inches, and most preferably about 0.25 inches. In one embodiment of the present invention, the plastic deflector baffle 219 is mounted in the air collection chamber 215 with bypass openings around the plastic deflector baffle 219 so the jet stream water can flow into the main heating chamber 200. By way of example and not limitation, the pressure may be 3 psi in the air collection chamber 215 and 3.1 psi at the top 217 of the air collection chamber 215.

Water enters from the incoming water supply line 245 and continues through a supply line infeed valve 260, through the tank inlet 240 and into the main heating chamber 200. Hot water is delivered to the spout outlet 275 of the faucet 270 from the upper region of the main heating chamber 200 by way of the tank outlet 230 and subsequently the hot water line 235 which leads from the tank outlet 230 to the hot water spout outlet 275. The expansion chamber 205 is vented to the atmosphere by way of a tube 250 whose lower end is exposed to the interior of the expansion chamber 205 and whose upper end is opened to the atmosphere through the interior vent 255 of the faucet 270. In addition to preventing pressure above atmospheric pressure from developing in the expansion chamber 205, venting prevents a buildup of pressure in the main heating chamber 200, as discussed below. The tank has a conventional draining device 225.

If a user draws no hot water from the tank for an extended period of time, the water in the main heating chamber 200 and the expansion chamber 205 will be substantially evenly heated. When hot water is drawn from the tank it must necessarily be replenished with cold supply water. This allows a new heating cycle inflow of cold supply water to the tank from the incoming water supply line to effectuate an emptying of the expansion chamber 205 of water to provide a volume for incoming cold supply water to expand into as it is heated. Admitting replenishment supply water concurrently with emptying of the expansion chamber 205 is accomplished with a venturi valve 210. This venturi valve is shown in FIG. 2 and enlarged in FIG. 3.

As shown in FIG. 3, the venturi valve 210 is mounted in the expansion chamber 205. Cold supply water flows through the incoming water supply line 245 and through a bore 305 of the venturi valve. This cold supply water imposes pressure on the inlet 310 of a venturi orifice 315. Restricting the flow of the water by way of the small diameter orifice 315 results in a velocity increase in the orifice, and as a result a jet of water emerges from the exit end 325 of the orifice. Consonant with Bernoulli's principle, the increase in velocity in the orifice is accompanied by a decrease in water pressure relative to the pressure of the hot water in the expansion chamber 205. Hot water initially arrives at the expansion chamber 205 by expanding from the main heating chamber 200. Consequently, hot water from the expansion chamber 205 is drawn into the jet stream through the lateral hole 320 of the venturi valve 210, as described above. The stream of mixed hot and cold water, when discharged from the exit end 325 of the orifice, is at a pressure well below supply line pressure but is still sufficiently high to force hot water out of the main heating chamber 200, through the tank outlet 230 and into the hot water line 235 for subsequent user consumption.

While the present invention has been described with references to one or more particular embodiments, those skilled in the art will recognize that many changes may be made thereto without departing from the spirit and scope of the present invention. Each of these embodiments and obvious variations thereof is contemplated as falling within the spirit and scope of the present invention, which is set forth in the following claims.

What is claimed is:

1. A hot water dispensing system comprising a one-piece plastic tank having a main heating chamber, an expansion chamber, and an air collection chamber the main heating chamber in fluid communication with the expansion chamber and the air collection chamber.

2. The hot water dispensing system of claim 1, wherein said main heating chamber and said expansion chamber are each defined by walls composed of plastic.

3. The hot water dispensing system of claim 1, wherein said one-piece plastic tank comprises a body and a cover electromagnetically welded together.

4. The hot water dispensing system of claim 1, further comprising a heating element connected to said one-piece plastic tank and extending into said main heating chamber.

5. The hot water dispensing system of claim 4, wherein said heating element includes arms passing through orifices in a wall of said one-piece plastic tank.

6. The hot water dispensing system of claim 1, further comprising a plastic venturi valve located within said expansion chamber.

7. The hot water dispensing system of claim 6, said venturi valve includes a first inlet for receiving supply water, a second inlet for said expansion chamber to communicate with said venturi valve, and an outlet for emitting water.

8. The hot water dispensing system of claim 6, wherein said plastic venturi valve is injection molded.

9. The hot water dispensing system of claim 1, wherein said expansion chamber contains a venturi valve and said air collection chamber contains a plastic deflector baffle for separating the air and water entering said air collection chamber.

10. The hot water dispensing system of claim 1, wherein said air collection chamber is narrow relative to said main heating chamber.

11. The hot water dispensing system of claim 1, wherein said air collection chamber is located below said expansion chamber and alongside said main heating chamber, said air collection chamber and said main heating chamber being separated by a common plastic partition.

12. A hot water dispensing system, comprising a one-piece plastic tank having a main heating chamber, an expansion chamber, and an air collection chamber, said air collection chamber being disposed generally below said expansion chamber and alongside said main heating chamber, said main heating chamber being in fluid communication with said expansion chamber and said air collection chamber.

13. The hot water dispensing system of claim 12, wherein said one-piece plastic tank is injection molded.

14. The hot water dispensing system of claim 12, wherein said one-piece plastic tank includes first and second internal plastic walls, said first internal wall separating said main heating chamber from said air collection chamber, said second internal wall separating said expansion chamber from both said main heating chamber and said air collection chamber.

15. The hot water dispensing system of claim 14, wherein said first internal wall includes an opening at a lower end, spaced from said expansion chamber, to provide fluid communication between said main heating chamber and said air collection chamber.

16. The hot water dispensing system of claim 12, wherein said air collection chamber is narrow relative to said main heating chamber.

17. The hot water dispensing system of claim 12, wherein said main heating chamber contains a heating element for heating water within said main heating chamber.

18. The hot water dispensing system of claim 12, wherein said expansion chamber contains a plastic venturi valve for directing water entering said valve into said air collection chamber.

19. The hot water dispensing system of claim 12, wherein said air collection chamber includes a plastic deflector baffle for separating the air and water entering said air collection chamber.

20. The hot water dispensing system of claim 19, wherein said plastic deflector baffle is located from about 0.1 inches to about 0.8 inches from the bottom of said venturi valve.

21. The hot water dispensing system of claim 20, wherein said plastic deflector baffle is located from about 0.2 inches to about 0.4 inches from the bottom of said venturi valve.

22. The hot water dispensing system of claim 21, wherein said plastic deflector baffle is located about 0.25 inches from the bottom of said venturi valve.

23. A temperature control system for a hot water dispenser, said dispenser including a one-piece plastic hot water tank, said temperature control system comprising:

a heating element disposed within said tank;

a metal temperature sensing bracket disposed outside said tank and connected to said heating element to detect a temperature of water within said tank; and a thermostat mounted to said metal temperature sensing bracket, said thermostat measuring a temperature of said metal temperature sensing bracket and thereby controlling said temperature of water within said tank.

24. The temperature control system of claim 23, wherein said thermostat controls said heating element in response to said measured temperature of said metal temperature sensing bracket.

25. The temperature control system of claim 23, wherein said heating element includes one or more arms passing through respective first orifices formed in a wall in said one-piece plastic hot water tank and respective second orifices formed in said metal temperature sensing bracket.

26. The temperature control system of claim 23, wherein said thermostat is a limiting thermostat.

27. The temperature control system of claim 23, further comprising a thermal cutout device mounted to said metal temperature sensing bracket.

28. The temperature control system of claim 27, wherein said thermal cutout device measures the temperature of said metal temperature sensing bracket and shuts off said heating element when the measured temperature reaches a preset maximum value.

* * * * *

UNITED STATES PATENT AND TRADEMARK OFFICE

CERTIFICATE OF CORRECTION

PATENT NO. : 6,266,485 B1
DATED : July 24, 2001
INVENTOR(S) : DeSantis et al.

It is certified that error appears in the above-identified patent and that said Letters Patent is hereby corrected as shown below:

Column 8, claim 1,
Line 3, delete "chamber the" and insert -- chamber, the --

Signed and Sealed this

Twenty-fifth Day of December, 2001

*Attest:*

*Attesting Officer*

JAMES E. ROGAN
*Director of the United States Patent and Trademark Office*